US009142372B2

(12) United States Patent
Kusch et al.

(10) Patent No.: US 9,142,372 B2
(45) Date of Patent: Sep. 22, 2015

(54) CONTACTOR ISOLATION METHOD AND APPARATUS

(75) Inventors: Ruediger Soeren Kusch, Clifton Park, NY (US); Robert Dean King, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 13/476,188

(22) Filed: May 21, 2012

(65) Prior Publication Data

US 2013/0307351 A1 Nov. 21, 2013

(51) Int. Cl.
*H01H 47/00* (2006.01)

(52) U.S. Cl.
CPC ..... *H01H 47/001* (2013.01); *H01H 47/002* (2013.01); *H01H 2231/026* (2013.01); *Y10T 307/826* (2015.04)

(58) Field of Classification Search
USPC ..... 307/125
See application file for complete search history.

(56) References Cited

U.S. PATENT DOCUMENTS

| | | | | |
|---|---|---|---|---|
| 5,369,540 | A | 11/1994 | Konrad et al. | |
| 6,115,831 | A | 9/2000 | Hanf et al. | |
| 6,556,413 | B1 * | 4/2003 | Rice et al. | 361/160 |
| 6,590,758 | B1 | 7/2003 | Friede et al. | |
| 2004/0130288 | A1 | 7/2004 | Souther et al. | |
| 2006/0071645 | A1 | 4/2006 | Bolton | |
| 2006/0091857 | A1 | 5/2006 | Nakanishi et al. | |
| 2006/0152189 | A1 | 7/2006 | Ambrosio et al. | |
| 2007/0164693 | A1 | 7/2007 | King et al. | |
| 2008/0143288 | A1 * | 6/2008 | Iwaji et al. | 318/722 |
| 2008/0312782 | A1 | 12/2008 | Berdichevsky et al. | |
| 2010/0250194 | A1 * | 9/2010 | Newhouse et al. | 702/183 |
| 2011/0144840 | A1 | 6/2011 | Ye et al. | |
| 2011/0163724 | A1 | 7/2011 | Migaud et al. | |
| 2011/0218698 | A1 * | 9/2011 | Bissontz | 701/22 |
| 2012/0206100 | A1 * | 8/2012 | Brown et al. | 320/109 |

FOREIGN PATENT DOCUMENTS

EP 0798895 A1 10/1997

OTHER PUBLICATIONS

Pahlevaninezhad et al., "A New Control Approach Based on the Differential Flatness Theory for an AC/DC Converter Used in Electric Vehicles," IEEE Transactions on Power Electronics, vol. 27, No. 4, Apr. 2012, pp. 2085-2103.

(Continued)

*Primary Examiner* — Jared Fureman
*Assistant Examiner* — Duc M Pham

(57) ABSTRACT

A contactor unit includes an input lead connectable to a first lead of an energy output device, an output lead connectable to a first lead of a voltage bus, a contactor that connects and disconnects the input lead from the output lead, a driver configured to operate the contactor, a serial data link connectable to a system controller that is external to the contactor unit, and an integrated circuit (IC) positioned within the contactor unit and configured to output a control command to the driver to open the contactor based on at least one of a current in either the input lead or the output lead and a voltage differential across the contactor, and output a contactor control status via the serial data link.

20 Claims, 5 Drawing Sheets

(56) References Cited

OTHER PUBLICATIONS

EP Search Report and Opinion dated Aug. 16, 2013 from corresponding EP Application No. 13168098.5.

Portions of "ETX-I First-Generation Single-Shaft Electric Propulsion System Program vol. I Powertrain Final Report", Feb. 1987.

* cited by examiner

CONTACTOR ISOLATION METHOD AND APPARATUS

BACKGROUND OF THE INVENTION

Embodiments of the invention relate generally to an isolation and feedback system for an electrical energy storage system that, in one embodiment, is applicable to electric drive systems including hybrid and electric vehicles.

Hybrid electric vehicles may combine an internal combustion engine and an electric motor powered by an energy storage device, such as a traction battery, to propel the vehicle. Such a combination may increase overall fuel efficiency by enabling the combustion engine and the electric motor to each operate in respective ranges of increased efficiency. Electric motors, for example, may be efficient at accelerating from a standing start, while internal combustion engines (ICEs) may be efficient during sustained periods of constant engine operation, such as in highway driving. Having an electric motor to boost initial acceleration allows combustion engines in hybrid vehicles to be smaller and more fuel efficient.

A purely electric vehicle (EV) uses stored electrical energy to power an electric motor, which propels the vehicle and may also operate auxiliary drives. Purely electric vehicles may use one or more sources of stored electrical energy. For example, a first source of stored electrical energy may be used to provide longer-lasting energy (such as a low-voltage battery) while a second source of stored electrical energy may be used to provide higher-power energy for, for example, acceleration (such as a high-voltage battery or an ultracapacitor).

Plug-in electric vehicles (PHEV), whether of the hybrid electric type or of the purely electric type, are configured to use electrical energy from an external source to recharge the energy storage devices. Such vehicles may include on-road and off-road vehicles, golf carts, neighborhood electric vehicles, forklifts, and utility trucks as examples. These vehicles may use either off-board stationary battery chargers, on-board battery chargers, or a combination of off-board stationary battery chargers and on-board battery chargers to transfer electrical energy from a utility grid or renewable energy source to the vehicle's on-board traction battery. Plug-in vehicles may include circuitry and connections to facilitate the recharging of the traction battery from the utility grid or other external source, for example.

Thus, hybrids and EVs in general typically include at least one, and oftentimes several, low or high voltage storage devices or other sources of power. Known devices include but are not limited to a power battery that operates at 400 V or greater, an energy battery operating optimally at 120 V, or an auxiliary power unit (APU) that may include an internal combustion engine (ICE), a permanent magnet generator (PMG), or a fuel cell (FC). The APUs for use in an electric vehicle may have their own unique operating voltage which may be at 400 V or greater as well. For instance, at a desired operating condition an ICE may output a voltage that is different from that of, for instance, a power battery or from other operating voltages of high voltage devices in an EV. Or, a PMG may itself operate at an operating voltage that is different from other devices within a system. Further, EVs often include high voltage devices that vary from manufacturer to manufacturer and from one type to another. For instance, one manufacturer may fabricate an ICE that outputs optimally 400 V while another manufacturer may fabricate an ICE that outputs 380 V optimally. As such, components and sub-systems may be designed into a hybrid or an EV having a wide variety of operating voltages.

During the design cycle of a hybrid or an EV, it is often desirable to be able to swap out different high voltage sub-systems in order to test the sub-system for eventual inclusion in the final design. That is, APUs that include ICEs, PMGs, or FCs may be tested and swapped out with other devices any number of times before settling on the final unit(s) to be used. Similarly, different high voltage power batteries and relatively low voltage energy batteries may likewise be tested during a lengthy and rigorous design and testing stage. As is known in the art, it is desirable to enable simple and quick connection and disconnection of such sub-systems during the design and test stage (i.e., during the experimental stage) of a hybrid vehicle or EV. Oftentimes the connection/disconnection functionality is provided by use of electro-mechanical contactors that are all controlled by a main processing unit.

Electro-mechanical contactors are used in a variety of environments for turning on and off a power source to a load electrically. The contactors include movable contacts and fixed contacts. The movable contacts are connected to an electromagnet and are controlled to selectively turn on or off power from the source to the load. The contacts are typically maintained in an open position by way of a spring and are caused to translate to a closed position when power to the electromagnet's coil is applied.

The contactors for high voltage operation typically include specific design parameters in order to provide the necessary operation capability. In systems where high voltage energy storage devices are being used, contactors are often included for safety purposes. It is often desirable for safety purposes to monitor voltages and currents in order to provide quick and safe shutdown in the event of a voltage or current excursion. In order to provide the safety features in early experimental hybrid and EV designs, it is therefore often necessary to provide supporting hardware to operate the contactors and monitor the currents and voltages particular to each voltage device. Thus, one set of contactors and supporting hardware may have hardware and control settings specific to a 400 V operation of a power battery, another set of contactors and supporting hardware may have control settings specific to a 120 V operation of an energy battery, and another set of contactors may be specific to a voltage of an auxiliary power unit. Subsequently, when it is desired to continue testing of the design by swapping out components, the 400 V power battery may be changed out for another power battery having a different operating voltage, or perhaps for a different energy storage device type altogether (such as, for instance, an ultracapacitor).

Because each device being tested may have unique performance capability and/or operating voltage, when components are swapped the contactors or their control settings may prove to be inadequate, as well as the additional hardware used to provide current and voltage monitoring. As such, each swap of a hardware component can result also in a need to swap out the contactors, to swap out the current and voltage monitoring, and/or to alter the control parameters for contactor operation.

When preparing a test setup of a hybrid or an EV, it is often necessary to include hardware connections and feedback monitoring capability of the specific devices being tested. That is, each device (storage, APU, etc. . . . ) typically includes its own contactors and feedback system that is specific to the device being tested. Thus, whenever re-arranging components, swapping out components, or adding new components, additional contactors and feedback monitoring capability is also included in order to provide the necessary functionality specific to each component. Because this functionality may be so specific, a significant amount of additional work is necessary when changing out components. That is, control schemes (overall current, rate of current change, contactor voltage, etc. . . . ) may change based on the type of component being used. Because the control scheme for testing the unit is typically implemented in a main control unit, changing out components can result in a need to make costly and time-consuming changes to both hardware and software control schemes.

In fact, more generally, when testing experimental systems having multiple energy storage and supply devices therein, such problems are also encountered as well. That is, in general when experimental systems are being tested in order to determine optimal system performance, and when such systems include potentially multiple different types of energy storage and supply systems, often the experimental stage is hindered because of the costly and time-consuming need to monitor and provide feedback from the sub-systems being tested. Such systems may include but are not limited to trains, aircraft, ships, wind-power systems, solar photovoltaic systems, to name but a few. Thus, the problem is not limited to hybrid vehicles or EVs, but includes any system that may require complex experimental systems having multiple energy storage and generating sub-systems associated therewith.

It would therefore be desirable to provide a contactor that is independently controllable without a need to change out hardware and control schemes when swapping out devices in a system having one or more devices that are selectively isolated.

BRIEF DESCRIPTION OF THE INVENTION

The present invention provides a system and method for enabling isolation of electrical energy storage components and for providing feedback in a compact device.

In accordance with one aspect of the invention, a contactor unit includes an input lead connectable to a first lead of an energy output device, an output lead connectable to a first lead of a voltage bus, a contactor that connects and disconnects the input lead from the output lead, a driver configured to operate the contactor, a serial data link connectable to a system controller that is external to the contactor unit, and an integrated circuit (IC) positioned within the contactor unit and configured to output a control command to the driver to open the contactor based on at least one of a current in either the input lead or the output lead and a voltage differential across the contactor, and output a contactor control status via the serial data link.

In accordance with another aspect of the invention, a method of operating an isolation contactor comprising attaching an input lead of the isolation contactor to a first lead of an energy output device and an output lead of the isolation contactor to a voltage bus, measuring a current passing through one of the input lead and the output lead, measuring a voltage across a switch that is positioned within a housing of the isolation contactor and coupled to the input lead and the output lead, the switch configured to disconnect the input lead from the output lead, conveying signals that are representative of the measured current and the measured voltage to an integrated circuit (IC) that is positioned within the housing of the isolation contactor, controlling a driver based on the signals conveyed to the IC, the driver configured to operate the switch, and outputting a status of the switch to a computing device external to the housing via a serial link.

In accordance with yet another aspect of the invention, a system for isolating a first voltage device from a second voltage device, the system includes an isolating unit having at least first and second leads external thereto and connectable to leads of respective energy devices, a switch positioned within a housing of the isolating unit and coupled to the first and second leads such that the first and second leads are selectively engageable via the switch, a driving unit positioned within the housing and configured to engage and disengage the switch, an integrated circuit (IC) positioned within the housing and configured to output a control command to the driving unit to open the switch based on at least one of a current in either the first lead or the second lead and a voltage differential across the switch, and output a system control status via a serial data link.

Various other features and advantages of the present invention will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention set forth herein relate to a contactor isolation feedback method and apparatus. A core unit includes a contactor that isolates a voltage supply from its circuit that based on internally provided thresholds and other operating parameters specific to the voltage supply. The core unit receives power to operate the contactors and other internal components, and the core unit outputs operating information to a main system controller via a signal interface.

Figure 1:
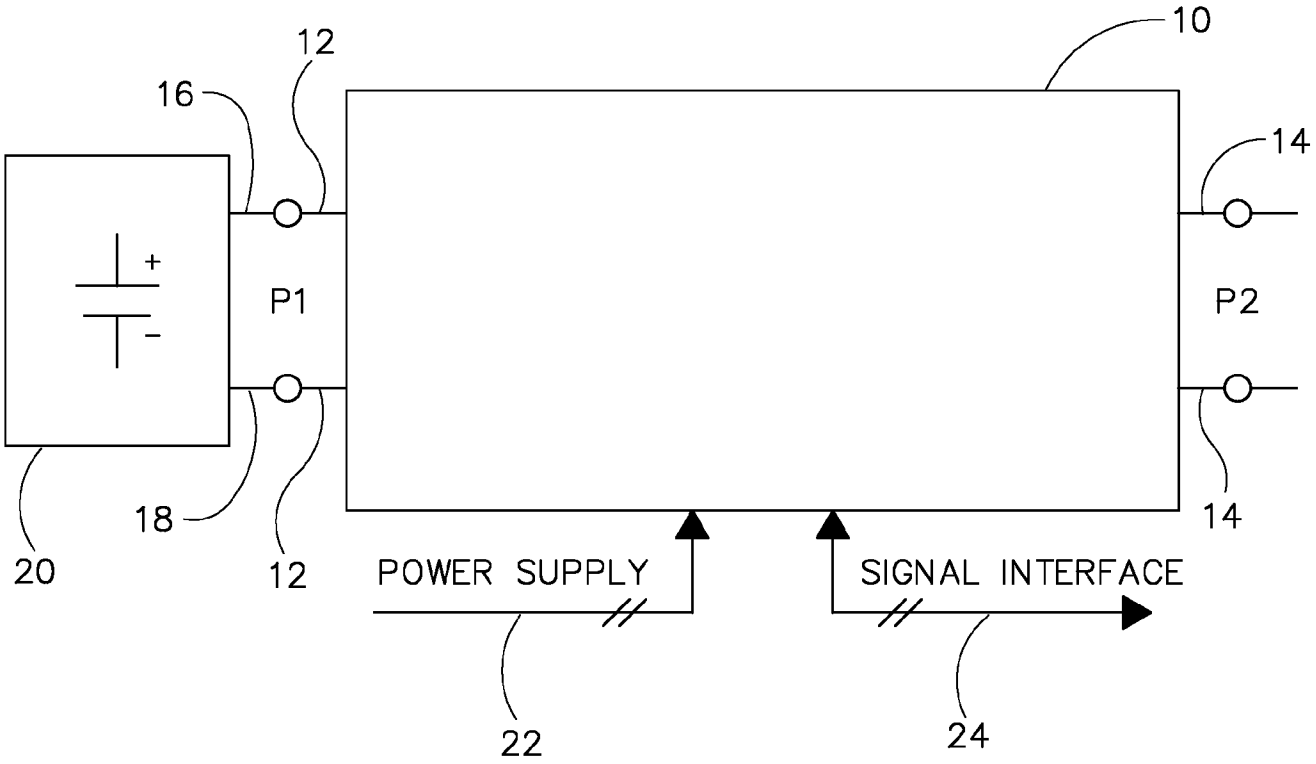
FIG. 1 illustrates a two-pole isolation contactor with feedback control according to an embodiment of the invention.

Referring to FIG. 1, isolation contactor 10 includes input leads 12 and output leads 14. Input leads 12 are connectable to respective positive 16 and negative 18 leads of an energy source 20 and output leads 14 are connectable to leads of a voltage bus of, for instance, an energy storage system. Energy source 20 may include but is not limited to a power battery that operates at 400 V or greater, an energy battery operating optimally at 120 V, or an auxiliary power unit (APU) that may include an internal combustion engine (ICE), a permanent magnet generator (PMG), or a fuel cell (FC). Operating voltages or voltage differentials between input leads 12 in fact can be in any range of voltage, from 10 V or below to 400 V or greater.

Isolation contactor 10 also includes a power supply line 22 to carry power for operation of one or more contactors in isolation contactor 10, as will be further discussed. Isolation contactor 10 also includes a signal or serial interface line 24 that includes digital communication to and from isolation contactor 10. That is, signal interface line 24 may be used to provide feedback information regarding the operation of contactor 10 to a computer or other control system that is external to isolation contactor 10, as well as to provide control signals for operation thereof, as will also be discussed. However, as will also be illustrated, isolation contactor 10 is a compact device and acts as a standalone unit that can be programmed with threshold values in order to provide functionality to a system independent of what components are provided to the system. That is, operating thresholds for currents and voltages may be pre-programmed into isolation contactor 10 and specific to desired operating characteristics specific to the device selected, such as energy source 20. Further, the thresholds may be re-programmed, using signal interface 24 in one embodiment, in order to provide flexibility of operation flexibility of system design.

In addition, FIG. 1 illustrates that both leads 16 and 18 of energy source 20 are coupled to isolation contactor 10 and, as will be described, isolation contactor 10 may be coupled to one of the leads such as positive lead 16, the other lead such as negative lead 18, or both leads 16, 18. That is, in one embodiment of the invention, one, the other, or both of leads 16, 18 may be isolated and controlled, having feedback to each or both as well via signal interface line 24.

Figure 2:
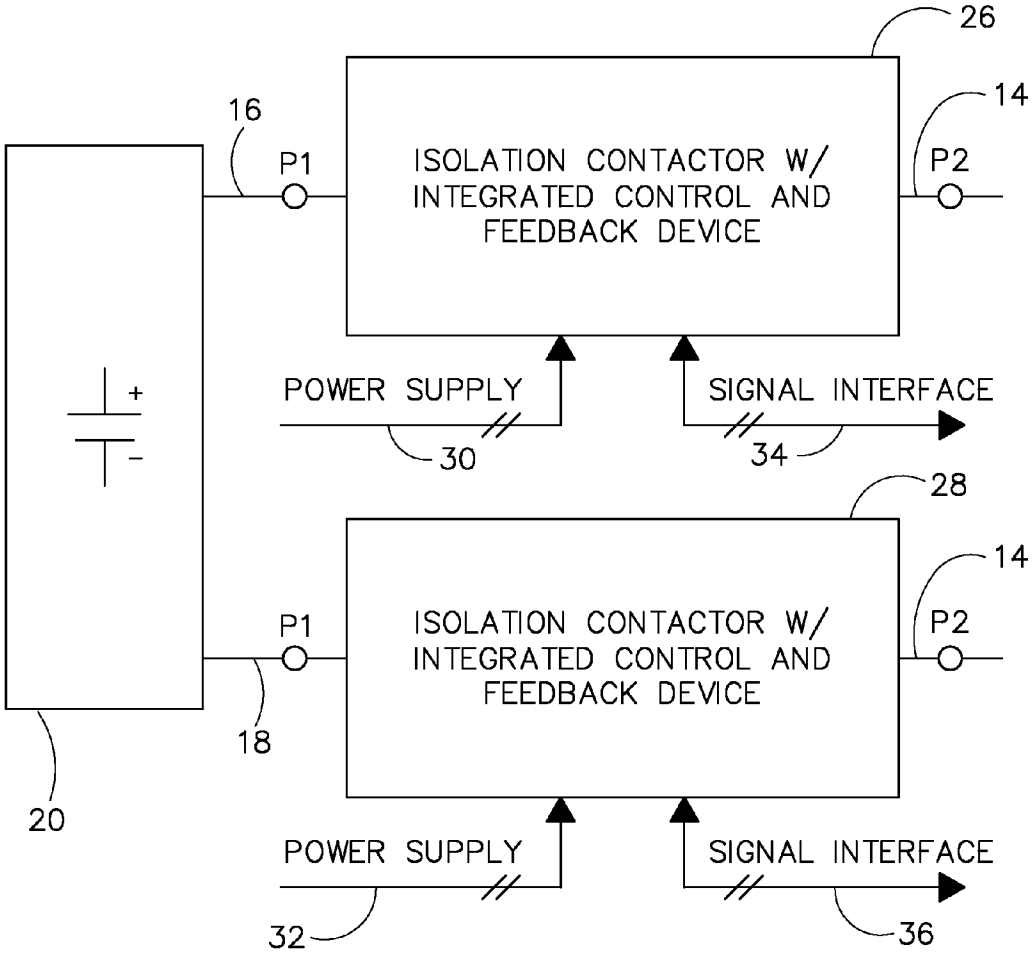
FIG. 2 illustrates two single-pole isolation contactors, each with feedback control according to an embodiment of the invention.

Referring now to FIG. 2, isolation control may be provided separately to leads 16 and 18 of energy source 20. That is, a first isolation contactor 26 may be coupled to positive lead 16, and a second isolation contactor 28 may be coupled to negative lead 18, in order to provide separately controllable isolation and feedback to the separate leads 16, 18 of energy source 20. Further, each isolation contactor 26, 28 may include its own respective power supply line 30, 32, and each isolation contactor 26, 28 may include its own signal interface 34, 36. Thus, complete system flexibility may be provided by enabling isolation and control of one pole or both poles 16, 18, by providing isolation control by using a single device 10 coupled to both poles 16, 18 (FIG. 1), or by separate contactors 26, 28 (FIG. 2).

Figure 3:
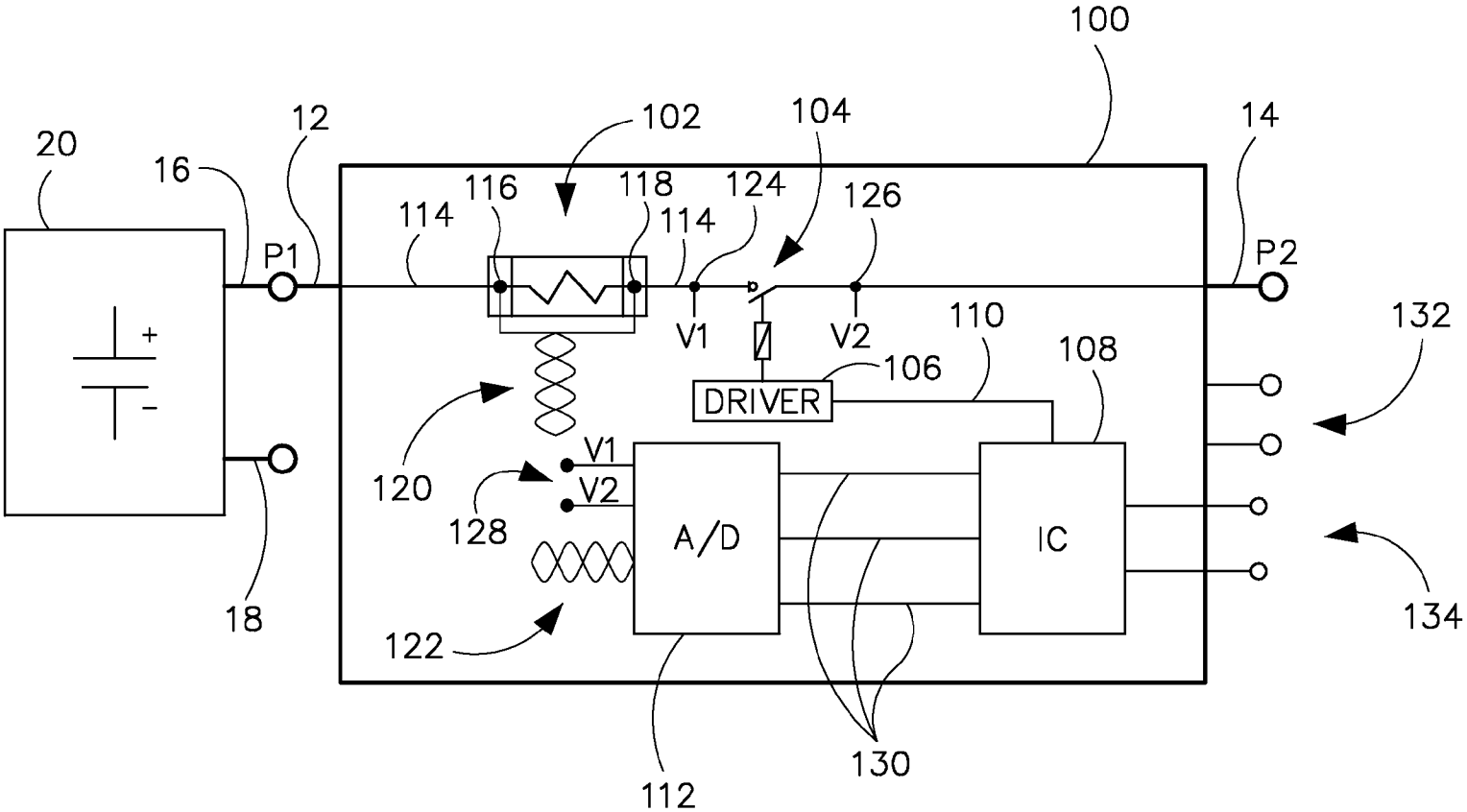
FIG. 3 illustrates a single pole isolation contactor, similar to one of the single-pole contactors of FIG. 2, and further illustrates internal components thereof according to an embodiment of the invention.

FIG. 3 illustrates internal components of an isolation contactor, according to an embodiment of the invention. Isolation contactor 100 is connectable to a single pole, such as positive pole 16 of energy source 20. However, it is understood that isolation contactor 100 may equally be coupled instead to negative pole 18 of energy source 20 as well. Thus, isolation contactor 100 represents one of the isolation contactors 26, 28 as illustrated in FIG. 2. Isolation contactor 100 includes components contained therein that enable isolation and feedback between leads 16 and 14. The components include a current shunt 102 and a switch or contactor 104 that is activated or operated by a driver 106. Driver 106 is coupled to an integrated circuit 108 via a driver control line 110. Integrated circuit 108, in one embodiment, is an application specific integrated circuit (ASIC). Isolation contactor 100 includes an analog/digital (A/D) converter 112 that, as commonly known in the art, converts incoming analog signals, such as a voltage, to a digital representation thereof. The core unit is thereby a data conversion and data framing integrated circuit that, in one embodiment, is an ASIC that processes single bit sigma-delta bit streams and frames the data into a proprietary or standard serial protocol to transmit values upstream. Also, it receives commands to configure data processing performance and includes simple commands to perform contactor actions.

Isolation contactor 100 includes a first lead 114 that, as illustrated, is coupleable to a high voltage device, such as energy source 20, via positive lead 16. First lead 114 includes current shunt 102 which, as is commonly known in the art, enables a current in a lead to be measured by including a known resistance therein. Because the resistance of current shunt 102 is known, by taking an accurate measurement of the voltage drop to either side of current shunt 102 the current can be determined with the well known Ohm's Law: Voltage (V)=Current (I)×Resistance (R). The voltage drop across current shunt 102 is determined between a first voltage measurement point 116 and a second voltage measurement point 118 by using a twisted pair 120 that extracts the voltages and feeds them 122 to A/D converter 112.

A voltage differential across contactor 104 is also determined by extracting voltage V1 124 and voltage V2 126 and feeding the voltages 128, as well, to A/D converter 112. A/D converter 112 receives the incoming voltages for current shunt 102 and contactor 104 via twisted pair 120, determines current in current shunt 102, and sends current and voltage information as a digitized signal to integrated circuit 108 via one or more data stream and control interface lines 130. Integrated circuit 108 receives continuous current data regarding the current in first lead 114 and also receives voltage data across contactor 104. As stated, integrated circuit 108 includes threshold information related to at least the current in first lead 114 and also related to the voltage drop across isolation contactor 104. That is, integrated circuit 108 is programmed with desired operating thresholds for both current in first lead 114 and for the voltage drop between V1 point 116 and V2 point 118, and such information may be specific to the type of energy device or specific to a manufacturer, as it pertains to energy source 20.

Accordingly, isolation contactor 100 is a compact device that combines the function of isolation via contactors 104, and provides control of contactors 104 while sensing current and voltages at different sensing points. In systems wherein high voltage energy storage devices are being used, the contactor operation as well as the monitored voltages and currents provide an opportunity for enhancing safe operation of an overall system. That is, because isolation contactor 100 includes a separately programmable device such as integrated circuit 108, different thresholds and operating characteristics can be pre-programmed specific to a device such as energy source 20. Thus, when energy source 20 is swapped out during the design and test phase of a larger overall system, the functionality of isolation contactor 100 can be simply and safely maintained by merely changing out operating parameters specific to the swapped out device without the need for costly and time-consuming changes to hardware. That is, high voltage isolation and voltage monitoring can be added to an electrical system at any point in time and does not need to be fully designed in the early planning stage. In other words, isolation contactor 100 provides an opportunity to defer a decision on what energy system 20 will be included in a final design, providing the opportunity to test and experiment during the design stage of system development, without having to make early decisions regarding energy system 20 that are later much more difficult to change or undo.

The number of electronic components is relatively small, which therefore means that the components can all be included within a single housing of isolation contactor 100. That is, isolation contactor 100 can be made small and compact and have a limited number of input and output leads. For instance, referring still to FIG. 3, isolation contactor 100 simply includes input lead 12, output lead 14, power leads 132 (for operating driver 106, A/D converter 112, and integrated circuit 108), and serial interface leads 134. Isolation contactor 100 may therefore be simply 'dropped into' a system that is or will be undergoing further design and experimental testing, while deferring the decision on what energy system 20 (or type of system) will be tested during the experimental phase. Isolation contactor 100 may be included in line with a single pole of an energy system as illustrated in FIG. 3, or two isolation contactors 26, 28 may be included with separate poles 16, 18 of an energy system as illustrated in FIG. 2.

Figure 4:
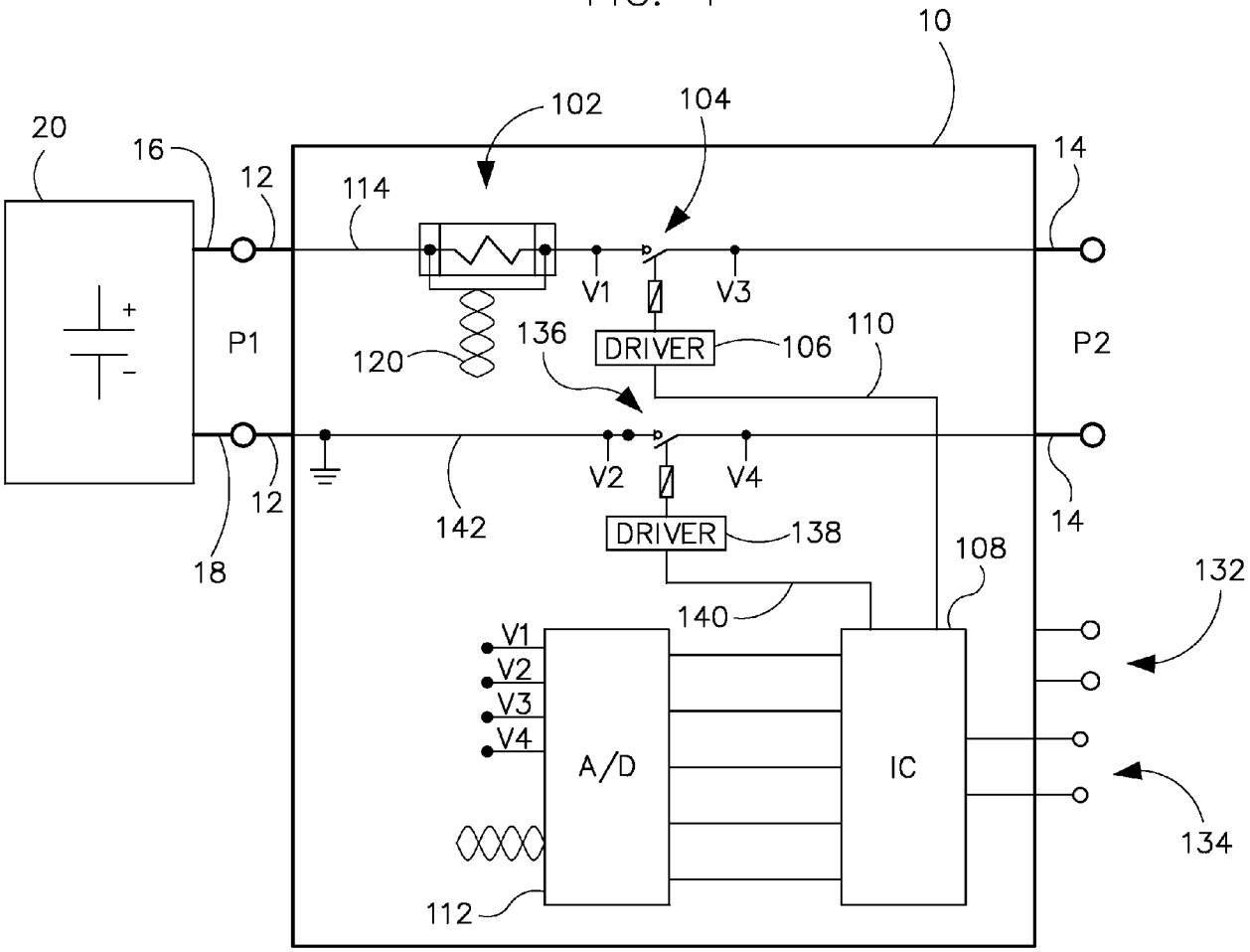
FIG. 4 illustrates a two-pole isolation contactor, similar to that illustrated in FIG. 1, and further illustrates internal components thereof according to an embodiment of the invention.

Or, as illustrated in FIG. 1, a single isolation contactor may be used to isolate two poles of an energy device. FIG. 4 illustrates internal components of an isolation contactor according to an embodiment of the invention. Isolation contactor 10, as illustrated in FIG. 1, includes positive and negative leads 16, 18 of energy system 20 that are connectable to leads 12. Output leads 14 are connectable as positive and negative leads to a DC bus, corresponding to positive lead 16 and negative lead 18. Much like FIG. 3, isolation contactor 10 of FIG. 4 includes current shunt 102 and a contactor 104 that is controllable via integrated circuit 108 and driver control line 110, and via driver 106. However, in this embodiment, negative lead 18 is separately controlled via a second contactor 136 and a second driver 138 and a second control line 140. In this embodiment, because each contactor 104, 136 is separately controllable, each may have its own control parameters and thresholds of operation, enabling yet additional control of the contactors for each lead 16, 18 of energy system 20. Thus, in this embodiment, should current surges or voltage spikes occur in lead 16 is quickly and detectable, and energy system 20 may be controlled, via either or both contactor 104, 136.

The embodiment illustrated in FIG. 4 illustrates one current shunt 102. However, the invention is not so limited, and current shunt 102 may be included also on second lead 142. In yet another embodiment, a separate current shunt may be included on each line 114 and 142. Thus, according to the invention, both leads 16, 18 may be controlled in a single unit, such as isolation contactor 10 having two contactors 104, 136 therein. Or, both leads 16, 18 may be separately controllable in two separate units, each having only one contactor therein, such as illustrated in FIG. 2.

In operation, the embodiments illustrated in FIGS. 1-4 provide system isolation and feedback to a controller during an experimental stage of system development. As one example, referring to FIG. 4, input leads 12 are connected to poles 16 and 18 of energy source 20, and output leads 14 are connected to respective positive and negative leads of a DC bus (not shown). Power is provided to isolation contactor 10 via power leads 132, and serial interface leads 134 are connected to a system controller or computer (not shown). A/D converter 112 receives voltage differential measurement data via twisted pair 120 and also receives voltage information (V1, V2, V3, and V4) from each contactor 104, 136. A/D converter 112 converts the received voltages to digital signals and outputs the signals to integrated circuit 108. Integrated circuit 108 monitors the current and voltages and compares them to thresholds that are established that are particular to the device(s) to which isolation contactor 10 is connected, in this case energy source 20. When voltage or current excursions are detected that exceed the respective threshold, integrated circuit 108 subsequently sends a command signal to open one or both isolation contactors 104, 136 and also sends out a control status or signal corresponding to the command signal. In such fashion isolation contactor 10 monitors the leads, compares voltage therein to threshold values, opens one or both contactors of the leads based on a comparison of the voltages to the threshold values, and outputs a digital signal as feedback that is indicative of the status of the leads (open or closed). In addition, integrated circuit 108 outputs, in embodiments of the invention, the measured voltages as well in order to continuously monitor not only the status of the contactors but also the voltages and/or current in the leads as well.

Embodiments of the isolation contactor disclosed herein may be used in any system in which it is desirable to provide electrical isolation and feedback to one or more poles or leads that is configured to carry electrical power. As stated, one such application includes for use in a high voltage device such as a hybrid vehicle or an electric vehicle. Such systems may also include but are not limited to trains, aircraft, ships, wind-power systems, solar photovoltaic systems, to name but a few. Thus, the problem is not limited to hybrid vehicles or EVs, but includes any system that may require complex experimental systems having multiple energy storage and generating subsystems associated therewith. That is, when setting up an experimental system that is going through rigorous design and testing, it may be desirable to include one or more isolation contactors that can have control thresholds, for current and voltages, as disclosed in embodiments herein.

Using embodiments of the invention, high voltage isolation and voltage monitoring and feedback can be added to an electrical system at any point in time and does not need to be fully considered in the early planning stage. That is, a system can be built in which various voltage supply units will be tested in order to validate a design, qualify a manufacturer, or test a new device, as examples. Thus, although the following illustration in FIG. 5 is specific to a 4-port energy management system for charging various energy storage devices and energy sources of a hybrid vehicle, it is contemplated that the embodiments disclosed herein may be used in any system in which it is desirable to provide the flexibility of operation during a design and testing phase, in order to provide feedback and control of one or more electrical leads.

Figure 5:
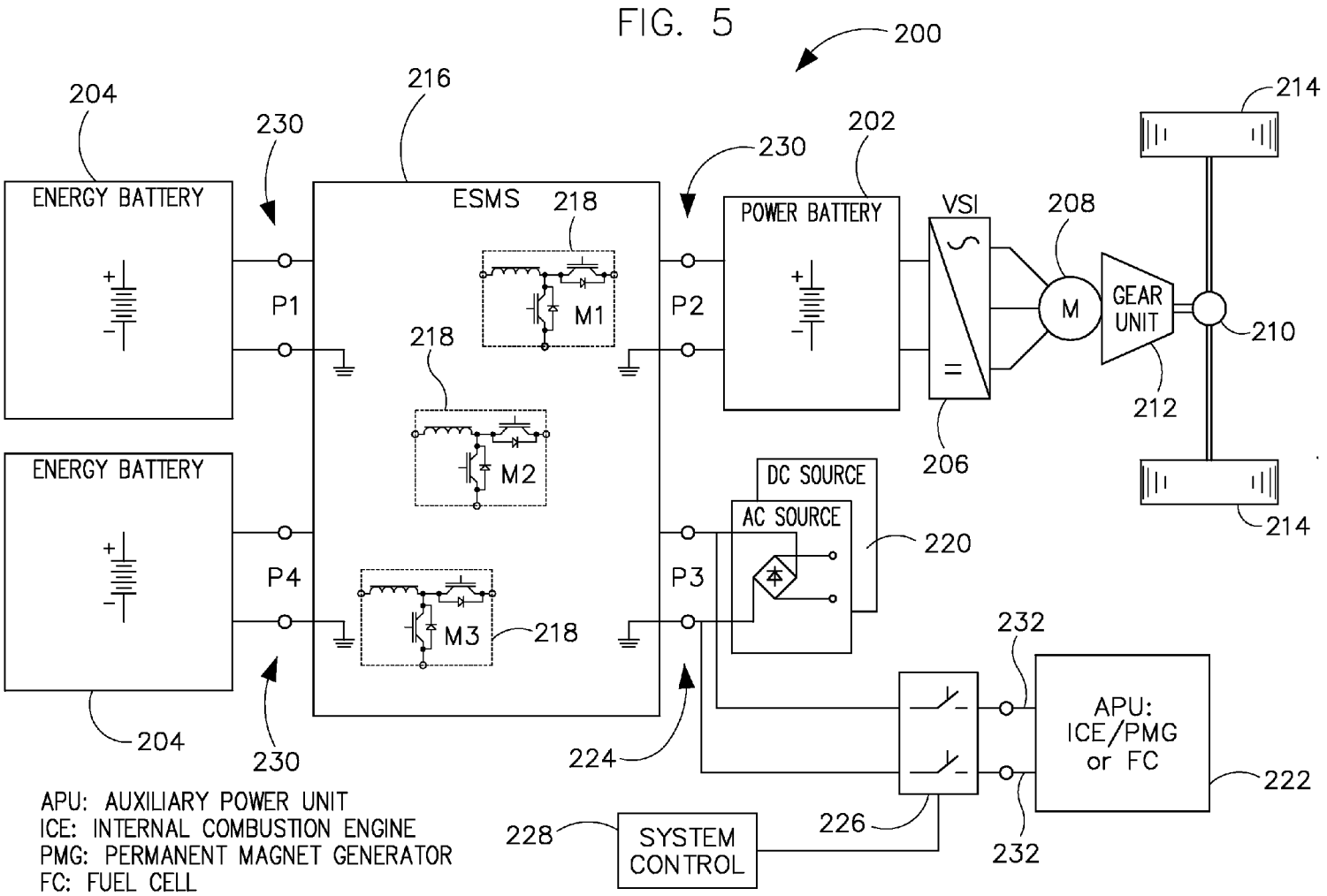
FIG. 5 illustrates an electric vehicle as an exemplary system that can benefit from embodiments of the invention.

Referring now to FIG. 5, according to the invention, a hybrid or electric vehicle 200 includes a power battery 202 and one or more energy batteries 204 and a source inverter 206 for inverting DC power from batteries 202, 204 in order to drive motor 208. Motor 208 is coupled to a differential 210 via a gear unit 212 in order to drive wheels 214. Energy batteries 204 may include relatively low voltage devices such as conventional batteries, or ultracapacitors, as examples, operating at approximately 120 V, which provide high energy storage capability for, as one example, long-range cruising of vehicle 200. Power battery 202 may include a relatively high voltage device to provide high power capability, operating at approximately 400 V or greater, which provide high power acceleration of vehicle 200, as another example. Vehicle 200 may include an energy storage management system (ESMS) 216 for charging batteries 202, 204. ESMS 216 may include a number of buck-boost converters 218 that can buck, or drop, a voltage when current is passing in one direction, and boost, or increase, a voltage when current is passing in another direction. That is, buck-boost converters 218 may be operated in conjunction with one another in order to adjust incoming charging voltages to match a desired operating voltage of a device to be charged, depending on the design of the system. Thus, as one example, one of the storage systems 204 may be charged at 120 V, and power battery 202 may be charged at 400 V. Thus, by selectively bucking and boosting voltage from a charge or supply 220 (AC or DC source), energy systems 204, 202 may be charged by properly directing current to flow through one or more of buck-boost converters 218.

However, in a system such as hybrid or electric vehicle 200 of FIG. 5, it may be desirable to develop an auxiliary power unit (APU) 222 that is positioned on vehicle 10 that enables energy storage system re-charge as well as providing power for vehicle operation. Vehicle 200 in this embodiment includes an APU 222 that may be controllably engaged through a charging port 224. Thus, vehicle 200 may include an APU that provides auxiliary power to electric motor 26 via ESMS 216. APU 222 may include an internal combustion engine (ICE), a permanent magnet generator (PMG), or a fuel cell (FC), as examples. That is, in conjunction with charger 220, during development of hybrid or electric vehicle 200 it may be desirable to test one or multiple types of APU in order to optimize the overall design. Thus, during the experimental stage, multiple APU types may be swapped in and out. In order to avoid costly and time-consuming swapping of hardware that is specific to each type of APU, according to the invention an isolation contactor 226 may be included that enables both isolation and feedback to a broader system control unit 228 that may be external to hybrid or electric vehicle 200.

Further, although isolation unit 226 is shown to be positioned in parallel with port P3 224, isolation units according to the embodiments disclosed herein may be included in any or all of the other ports 230 of hybrid or electric vehicle 200, as well. Further, as can be seen in FIG. 5, isolation contactor 226 includes isolation control of each lead 232 of APU 222, similar to that disclosed in FIG. 1 and in FIG. 4, it is contemplated that only one of leads 232 may be separately isolated using single line isolation such as that disclosed in FIG. 3, or that both leads 232 may be separately isolated using a single lead isolation system on each lead, as disclosed with respect to FIG. 2.

A technical contribution for the disclosed method and apparatus is that it provides for an isolation and feedback system for an electrical energy storage system.

Therefore, according to one embodiment of the present invention, a contactor unit includes an input lead connectable to a first lead of an energy output device, an output lead connectable to a first lead of a voltage bus, a contactor that connects and disconnects the input lead from the output lead, a driver configured to operate the contactor, a serial data link connectable to a system controller that is external to the contactor unit, and an integrated circuit (IC) positioned within the contactor unit and configured to output a control command to the driver to open the contactor based on at least one of a current in either the input lead or the output lead and a voltage differential across the contactor, and output a contactor control status via the serial data link.

According to another embodiment of the present invention, a method of operating an isolation contactor comprising attaching an input lead of the isolation contactor to a first lead of an energy output device and an output lead of the isolation contactor to a voltage bus, measuring a current passing through one of the input lead and the output lead, measuring a voltage across a switch that is positioned within a housing of the isolation contactor and coupled to the input lead and the output lead, the switch configured to disconnect the input lead from the output lead, conveying signals that are representative of the measured current and the measured voltage to an integrated circuit (IC) that is positioned within the housing of the isolation contactor, controlling a driver based on the signals conveyed to the IC, the driver configured to operate the switch, and outputting a status of the switch to a computing device external to the housing via a serial link.

According to yet another embodiment of the present invention, a system for isolating a first voltage device from a second voltage device, the system includes an isolating unit having at least first and second leads external thereto and connectable to leads of respective energy devices, a switch positioned within a housing of the isolating unit and coupled to the first and second leads such that the first and second leads are selectively engageable via the switch, a driving unit positioned within the housing and configured to engage and disengage the switch, an integrated circuit (IC) positioned within the housing and configured to output a control command to the driving unit to open the switch based on at least one of a current in either the first lead or the second lead and a voltage differential across the switch, and output a system control status via a serial data link.

The present invention has been described in terms of the preferred embodiment, and it is recognized that equivalents, alternatives, and modifications, aside from those expressly stated, are possible and within the scope of the appending claims.

What is claimed is:

1. A contactor unit comprising:

an input lead connectable to a first lead of an energy output device;

an output lead connectable to a first lead of a voltage bus;

a contactor that connects and disconnects the input lead from the output lead;

a driver configured to operate the contactor;

a serial data link connectable to a system controller that is external to the contactor unit; and an integrated circuit (IC) positioned within the contactor unit and configured to:

output a control command to the driver to open the contactor based on at least one of:

a current in either the input lead or the output lead; and a voltage differential across the contactor; and output a contactor control status via the serial data link.

2. The contactor unit of claim 1 wherein the IC is configured to:

receive voltage readings measured across the contactor and calculate the voltage differential based thereon;

compare the voltage differential to a voltage threshold value;

receive a current reading in either the input lead or the output lead;

compare the current reading to a current threshold value; and output the control command to the driver based on at least one of:

the comparison of the voltage differential to the voltage threshold; and the comparison of the current reading to the current threshold value.

3. The contactor unit of claim 2 wherein the IC is an application specific integrated circuit (ASIC) that is programmable such that operating variables of the contactor unit may be programmed, wherein the operating variables include the voltage threshold value and the current threshold value.

4. The contractor unit of claim 3 wherein the ASIC is programmable via the serial link from a computer that is external to the contactor unit.

5. The contactor unit of claim 2 comprising a current shunt positioned to provide the current reading, the current shunt having a first voltage measurement point to one side of the current shunt and a second voltage measurement point to another side of the current shunt, wherein the current reading is determined based on voltages measured at the first voltage measurement point and the second voltage measurement point.

6. The contactor unit of claim 5 comprising an analog/digital (A/D) converter configured to receive voltage values from a first voltage tap point and from a second voltage tap point, wherein the first voltage tap point is positioned to measure a voltage to one side of the contactor, and the second voltage tap point is positioned to measure a voltage to the other side of the contactor, wherein the IC is configured to:

determine the current reading based on the voltages measured at the first voltage measurement point and the second voltage measurement point; and calculate the voltage differential across the contactor based on the voltage measurements at the first and second voltage tap points.

7. The contactor unit of claim 1 comprising:

a second input lead connectable to a second lead of the energy output device;

a second output lead connectable to a second lead of the voltage bus;

a second contactor that connects and disconnects the second input lead from the second output lead;

a second driver configured to operate the second contactor;

wherein the IC is further configured to:

output a second control command to the second driver to open the second contactor based on at least one of:

a second current in either the second input lead or the second output lead; and a second voltage differential across the second contactor; and output a second contactor control status via the serial data link.

8. A method of operating an isolation contactor comprising:

attaching an input lead of the isolation contactor to a first lead of an energy output device and an output lead of the isolation contactor to a voltage bus;

measuring a current passing through one of the input lead and the output lead;

measuring a voltage across a switch that is positioned within a housing of the isolation contactor and coupled to the input lead and the output lead, the switch configured to disconnect the input lead from the output lead;

conveying signals that are representative of the measured current and the measured voltage to an integrated circuit (IC) that is positioned within the housing of the isolation contactor;

controlling a driver based on the signals conveyed to the IC, the driver configured to operate the switch; and outputting a status of the switch to a computing device external to the housing via a serial link.

9. The method of claim 8 comprising:

measuring the current and the voltage with an analog/digital (A/D) converter that is positioned within the housing; and outputting the conveyed signals as digital signals from the A/D converter.

10. The method of claim 8 comprising:

comparing, in the IC, the current passing through the one of the input lead and the output lead to a current threshold value;

comparing, in the IC, the voltage across the switch to a voltage differential threshold value; and controlling the driver based on the comparison of the current to the current threshold value, and based on the comparison of the voltage across the switch to the differential threshold value.

11. The method of claim 10 wherein the integrated circuit is an application specific integrated circuit (ASIC), the method further comprising programming the ASIC such that operating variables of the contactor unit may be programmed, wherein the operating variables include the voltage differential threshold value and the current threshold value.

12. The method of claim 11 comprising programming the ASIC via the serial link.

13. The method of claim 8 wherein measuring the current comprises measuring the current across a current shunt that is in series with one of the input lead and the output lead.

14. A system for isolating a first voltage device from a second voltage device, the system comprising:

an isolating unit having at least first and second leads external thereto and connectable to leads of respective energy devices;

a switch positioned within a housing of the isolating unit and coupled to the first and second leads such that the first and second leads are selectively engageable via the switch;

a driving unit positioned within the housing and configured to engage and disengage the switch;

an integrated circuit (IC) positioned within the housing and configured to:

output a control command to the driving unit to open the switch based on at least one of:

a current in either the first lead or the second lead; and a voltage differential across the switch; and output a system control status via a serial data link.

15. The system of claim 14 wherein the IC is configured to:

receive voltage readings measured in the first and second leads and calculate the voltage differential based thereon;

compare the voltage differential to a voltage threshold value;

receive a current reading from either the first lead or the second lead;

compare the current reading to a current threshold value; and output the control command to the driving unit based on at least one of:

the comparison of the voltage differential to the voltage threshold value; and the comparison of the current reading to the current threshold value.

16. The system of claim 15 wherein the IC is an application specific integrated circuit (ASIC) that is programmable such that operating variables of the contactor unit may be programmed, wherein the operating variables include the voltage threshold value and the current threshold value.

17. The system of claim 16 wherein the ASIC is programmable via the serial link from a computer that is external to the contactor unit.

18. The system of claim 15 comprising a current shunt positioned to provide the current reading and coupled to one of the first lead or the second lead, the current shunt having a first voltage measurement point to one side of the current shunt and a second voltage measurement point to another side of the current shunt, wherein the current reading is determined based on voltages measured at the first voltage measurement point and the second voltage measurement point.

19. The system of claim 18 comprising an analog/digital (A/D) converter positioned within the housing and configured to receive voltage values from a first voltage tap point and from a second voltage tap point, wherein the first voltage tap point is positioned to measure a voltage to one side of the switch, and the second voltage tap point is positioned to measure a voltage to the other side of the switch, wherein the IC is configured to:

determine the current reading based on the voltages measured at the first voltage measurement point and the second voltage measurement point; and calculate the voltage differential across the switch based on the voltage measurements at the first and second voltage tap points.

20. The system of claim 14 comprising:

third and fourth leads external to the isolating unit and connectable to leads of respective energy devices;

a second switch positioned within the housing of the isolating unit and coupled to the third and fourth leads of the respective energy devices;

a second driving unit positioned within the housing and configured to engage and disengage the second switch;

wherein the IC is further configured to:

output a second control command to the second driving unit to open the second switch based on at least one of: a second current in either the third or fourth leads; and a second voltage differential across the second switch; and output a second system control status via the serial data link.

* * * * *